US005502453A

United States Patent [19]

Tsukamoto et al.

[11] Patent Number: 5,502,453

[45] Date of Patent: Mar. 26, 1996

[54] PLANAR ANTENNA HAVING POLARIZER FOR CONVERTING LINEAR POLARIZED WAVES INTO CIRCULAR POLARIZED WAVES

[75] Inventors: Katsuya Tsukamoto, Hirakata; Takshi Saito, Shijonawate, both of Japan

[73] Assignee: Matsushita Electric Works, Ltd., Osaka, Japan

[21] Appl. No.: 390,419

[22] Filed: Feb. 17, 1995

Related U.S. Application Data

[63] Continuation of Ser. No. 978,792, Nov. 19, 1992, abandoned.

[30] Foreign Application Priority Data

Dec. 13, 1991 [JP] Japan ..... 3-329237

[51] Int. Cl.[6] ..... H01Q 19/00; H01Q 1/38

[52] U.S. Cl. ..... 343/756; 343/700 MS; 343/770

[58] Field of Search ..... 343/756, 700 MS, 343/767, 770, 909; 359/486, 494, 499, 500

[56] References Cited

U.S. PATENT DOCUMENTS

| | | | |
|---|---|---|---|
| 3,754,271 | 8/1973 | Epis | 343/756 |
| 4,387,377 | 6/1983 | Kandler | 343/756 |
| 4,475,107 | 10/1984 | Makimoto et al. | 343/700 MS |
| 4,477,815 | 10/1984 | Brunner et al. | 343/756 |
| 4,599,623 | 7/1986 | Havkin et al. | 343/756 |
| 4,652,886 | 3/1987 | Rosser et al. | 343/909 |
| 4,652,891 | 3/1987 | Rossuet et al. | 343/909 |
| 4,786,914 | 11/1988 | Wu et al. | 343/909 |
| 4,851,855 | 7/1989 | Tsukamoto et al. | 343/700 MS |
| 4,903,033 | 2/1990 | Tsao et al. | 343/700 MS |
| 4,926,189 | 5/1990 | Zaghloul et al. | 343/700 MS |
| 4,929,959 | 5/1990 | Sorbello et al. | 343/700 MS |
| 5,005,019 | 4/1991 | Zaghloul et al. | 343/700 MS |
| 5,258,768 | 11/1993 | Smith | 343/786 |
| 5,321,411 | 6/1994 | Tsukamoto | 343/700 MS |

*Primary Examiner*—Donald T. Hajec
*Assistant Examiner*—Tan Ho
*Attorney, Agent, or Firm*—Burns, Doane, Swecker & Mathis

[57] ABSTRACT

A planar antenna in multilayered arrangement of a grounding conductor plate, a power supplying circuit plate and a radiating circuit plate being separated from one another. Radiating elements of the radiating circuit plate are a plurality of apertures electromagnetically coupled to power supply probes of the power supplying circuit plate. On the radiating circuit plate, a polarizer capable of converting linear polarized waves into circular polarized waves is provided, whereby the antenna is enabled to ensure a high efficiency and wide-band cross polarization characteristics.

1 Claim, 3 Drawing Sheets

PLANAR ANTENNA HAVING POLARIZER FOR CONVERTING LINEAR POLARIZED WAVES INTO CIRCULAR POLARIZED WAVES

This application is a continuation of application Ser. No. 07/978,792, filed Nov. 19, 1992, now abandoned.

BACKGROUND OF THE INVENTION

This invention relates to planar antenna and, more particularly, to a planar antenna which realizes a high radiation efficiency and cross polarized wave characteristics over a wide band range.

The planar antenna of the kind referred to can be effectively employed with respect to broadcasting satellite or communication satellite.

DESCRIPTION OF RELATED ART

Generally, in place of conventional palabolic antennas involving cumbersome installation work and questionable in external appearance, there has been suggested such a planar antenna as has been disclosed in, for example, U.S. Pat. No. 4,475,107 (corresponding German Application P 31 49 200.2). In all events, it has been demanded for the planar antenna of this kind that the antenna realizes a higher gain in the reception and, for this purpose, there have been made a variety of attempts to reduce insertion loss. In U.S. Pat. No. 4,851,855 (corresponding to German Patent No. 37 06 051), for example, the present inventors K. Tsukamoto et al have suggested a planar antenna in which power supplying and radiating circuits and grounding conductor are held mutually separated through a space retaining means while rendering both of the power supplying and radiating circuits to be electromagnetically coupled for a power supply, instead of direct connection between them. With this arrangement, the power supplying circuit can be disposed in an internal space of the antenna so as to effectively reduce the insertion loss.

Further, in U.S. Pat. Nos. 4,929,959 and 5,005,019 to A. I. Zaghloul et al, there have been suggested further planar antennas in which the radiating circuit is formed with many annular slots provided in each of their center portions with a patch element, and the patch elements are electromagnetically coupled to power supply probes of the power supplying circuit one by one so that the insertion loss can be reduced and assembling ability can be improved.

According to these U.S. patents of Tsukamoto et al and Zaghloul et al, it is possible to attain the reduction of the insertion loss and the improvement in the assembling ability in contrast to any other known planar antenna. On the other hand, in these U.S. patents, too, the radiating circuit comprises slots of a square, circular or other shape and patch elements centrally disposed respectively in each of the slots so that a high precise etching process will be required therefor with a required etching pattern of the radiating plate made very complicated, and there have arisen such problem that manufacturing fluctuation due to an unevenness of the printed circuit board or the like becomes large thus lowering the yield of resulting products and required manufacturing costs are generally elevated.

Further, in an earlier invention disclosed in U.S. Pat. No. 5,270,721 (corresponding German Patent Application P 40 14 133.0), the present inventors K. Tsukamoto et al have suggested a planar antenna in which the radiating circuit plate is provided only with fully open apertures which are electromagnetically coupled to the power supplying probes of the power supplying circuit plate so that the function of radiating element can be attained only by the apertures without aid of such patch element as disclosed in the foregoing U.S. Patents.

According to this earlier invention, any high precision manufacturing is no longer required so as to render the manufacturing to be simpler, the radiating circuit can be formed simply through a punching work or the like with respect to a metal plate instead of the etching process with respect to the printed circuit board, and the productivity can be effectively improved.

In receiving the circular polarized wave with the antenna of the earlier invention, however, there has arisen a deterioration in the efficiency due to a leakage of electric waves in the parallel plate mode between the radiating circuit plate and the grounding conductor plate as a result of the electromagnetic coupling between the power supplying probes and the radiating elements formed only by the apertures of a special contour. Further, this leakage has involved a risk that the electric waves leaked out of any one of the apertures is coupled to another aperture so as to have the cross polarization characteristics deteriorated.

These have been bars to the attainment of the higher efficiency than in the case of the palabolic antenna and the excellent cross polarization characteristics over a wide-band.

SUMMARY OF THE INVENTION

A primary object of the present invention is, therefore, to provide a planar antenna which is excellent in the antenna efficiency over a wide band and in the cross polarization characteristics.

According to the present invention, this object can be realized by means of a planar antenna in a three layer structure of a grounding conductor plate, a power supplying circuit plate and a radiating circuit plate which are mutually separated, in which the radiating circuit plate is provided with apertures acting as radiating elements for a radiation of linear polarized waves as electromagnetically coupled to power supply probes in the power supplying circuit plate in physically non-contacting relationship, wherein a polarizer for converting the linear polarized waves into circular polarized waves is provided in front of the radiating circuit plate.

Other objects and advantages of the present invention shall be made clear in following description of embodiments of the invention detailed with reference to accompanying drawings.

Figure 1:
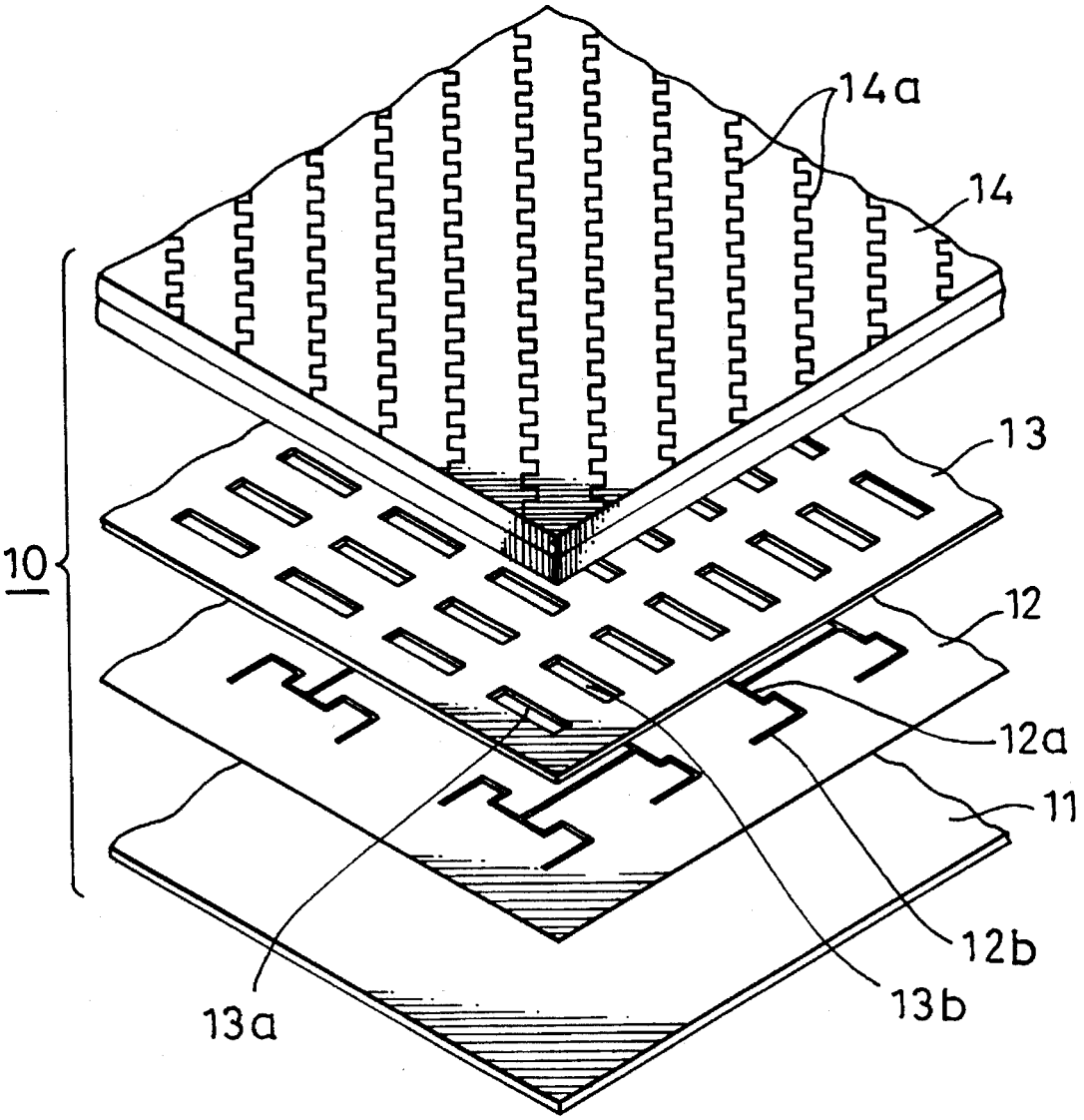
FIG. 1 shows in a fragmentary perspective view as disassembled the planar antenna in an embodiment according to the present invention.

While the present invention shall now be described with reference to the embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Referring here to FIGS. 1 through 5, there is shown a planar antenna 10 in an embodiment according to the present invention, which antenna 10 comprises a grounding conductor plate 11, a power supplying circuit plate 12 and a radiating circuit plate 13, which plates 11–13 are sequentially disposed to flatly face one another in the order mentioned, as mutually separated with spacers 15*a* and 15*b* of such plastic material as a foamed sheet interposed between the respective plates 11–13 to mutually separate them by the thickness of these spacers. Further, in front of the radiating circuit plate 13, there is provided a polarizer 14 capable of converting linear polarized wave into circular polarized wave.

For the grounding conductor plate 11, it is possible to employ, for example, an aluminum plate of a thickness 2 mm and available in the market, while a plate of such other electrically conducting material as copper, silver, astatin, iron, gold and the like may be employed. The power supplying circuit plate 12 is placed at a predetermined interval with respect to the grounding conductor plate 11 with the spacer 15*a* of the foamed plastic sheet or the like interposed between them. This power supplying circuit plate 12 comprises preferably a polyester substrate of 50 μm thick and a power supplying circuit pattern 12*a* formed on the substrate with a copper foil laminated thereon and subjected to an etching process for the pattern 12*a* including power supply probes 12*b* respectively disposed for electromagnetic coupling with the radiating elements in the radiating circuit plate 13. Further, for the radiating circuit plate 13, an aluminum plate of 0.4 mm thick, preferably, is employed, and rectangular apertures respectively 13 mm long and 2 mm wide are made in the plate in pairs 13*a* and 13*b* as mutually separated in width direction by 9 mm. According to an optimum aspect, the paired rectangular apertures 13*a* and 13*b* are formed as punched through the aluminum plate in 16 lines and 16 columns at intervals of 20 mm. Further, the radiating circuit plate 13 is placed at a desired interval with respect to the power supplying circuit plate 12 with such spacer 15*b* as the foamed plastic sheet interposed between them as required.

Figure 2:
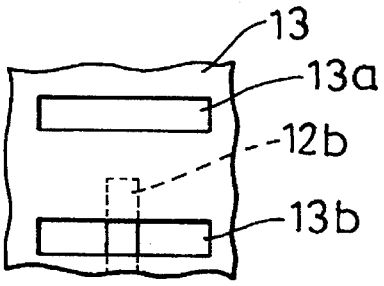
FIG. 2 shows in a fragmentary plan view as magnified a positional relationship between each pair of the apertures in the radiating circuit plate and each power supply probe in the power supplying circuit plate in the planar antenna of FIG. 1.

The power supply probes 12*b* of the power supplying circuit plate 12 and the apertures 13*a* and 13*b* in the pairs of the radiating circuit plate 13 should preferably be effectively electromagnetically coupled to each other, in particular, by disposing each of the power supply terminals 12*b* to intersect one aperture 13*b* of the paired apertures 13*a* and 13*b* and to position tip end of the terminal intermediate between the paired apertures 13*a* and 13*b* as seen in the plan view of FIG. 2.

Figure 3:
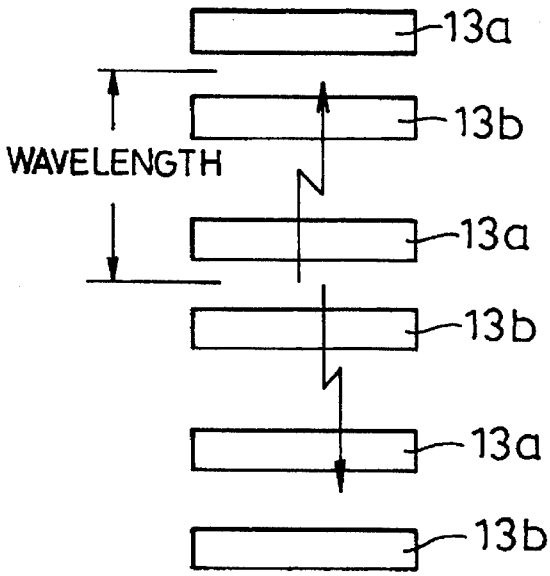
FIG. 3 is an explanatory view for the arrangement of the apertures of the radiating circuit plate in the planar antenna of FIG. 1.
Figure 4:
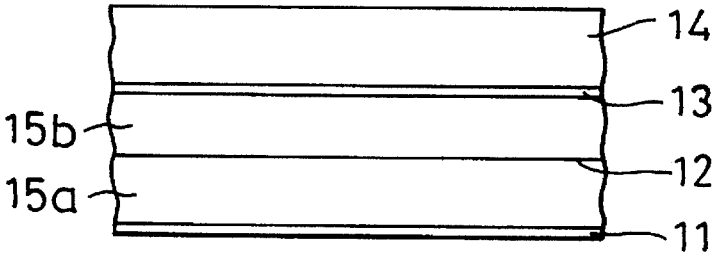
FIG. 4 is a fragmentary, schematic sectioned view of the planar antenna of FIG. 1.

As a result of the electromagnetically coupling between the power supply probes 12*b* of the power supplying circuit plate 12 and the paired apertures 13*a* and 13*b* of the radiating circuit plate 13, there occurs such electric wave of the parallel plate mode as has been partly described with reference to the related art, between the radiating circuit plate 13 and the grounding conductor plate 11, but this electric wave of the parallel plate mode will propagate in a linear direction since the paired apertures 13*a* and 13*b* are formed for the linear polarized wave. In this case, it is preferable that the respective pairs of the apertures 13*a* and 13*b* are arranged in the propagating direction of the parallel plate mode so that the electric waves occurring in the parallel plate mode will have a phase substantially of one (1) wavelength or an integral multiple thereof, as shown in FIG. 3.

With the above arrangement, the leakage electric wave occurring between the radiating circuit plate 13 and the grounding conductor plate 11 in the parallel plate mode is made to be radiated again out of other adjacent apertures 13*a* and 13*b*, as also matched in the same phase. That is, there can be realized a planar antenna structure capable of re-utilizing the leakage electric wave, and the leakage can be eliminated seemingly as a whole. Accordingly, it is possible to realize a highly efficient planar antenna.

In respect of the arrangement of the paired apertures 13*a* and 13*b* for rendering the phase of the foregoing electric wave of the parallel plate mode to be an integral multiple of the 1 wavelength, it is of course not always required to have the respective pairs of apertures 13*a* and 13*b* spaced physically by 1 wavelength. Further, while effective value of the wavelength is made to vary in accordance with the dielectric constant of the dielectric spacer 15*b* employed or a dimension of the apertures 13*a* and 13*b*, it will suffice the purpose to set the spacing of the paired apertures 13*a* and 13*b* optimumly in accordance with design requirements.

Figure 5:
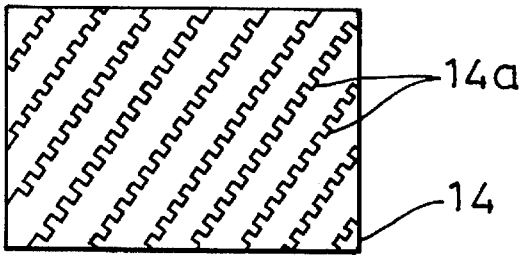
FIG. 5 is a fragmentary plan view of the polarizer in the planar antenna of FIG. 1.

Further, the polarizer 14 provided in front of the radiating circuit plate 13 comprises a flexible printed-circuit board on which a circuit pattern 14*a* of so-called meander conductor lines formed through an etching process, as will be specifically seen in FIGS. 1 and 5. Here, the polarizer 14 may be formed with, for example, three of the flexible printed-circuit boards respectively having circuit pattern 14a of meander conductor lines and with an insulating layer constituted by an optimum foamed plastic sheet interposed between the respective printed-circuit boards. Accordingly, it is possible to realize a polarizer arrangement capable of converting into the circular polarized wave highly efficiently over a wide-band the linear polarized wave of the linear polarized wave antenna which highly efficiently re-utilizing the leakage electric wave of the parallel plate mode.

Figure 6:
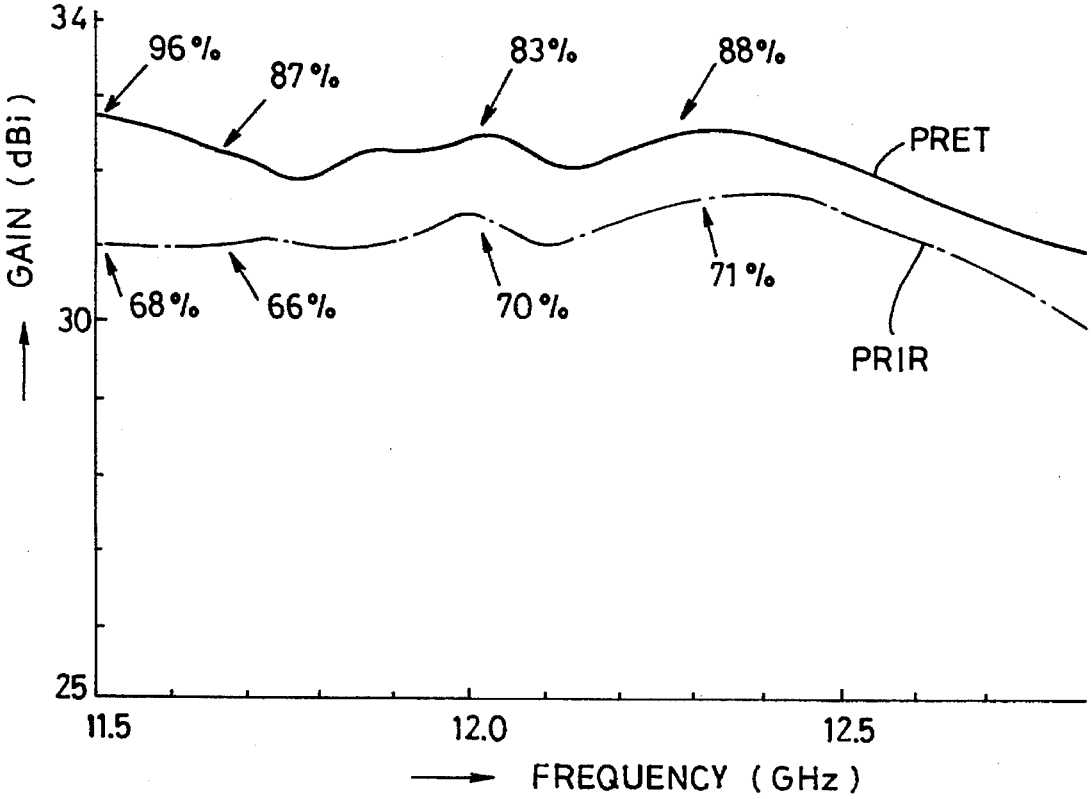
FIG. 6 is a diagram for graphically showing the gain characteristics of the planar antenna of FIG. 1 and of a conventional planar antenna.

According to the planar antenna 10 in the instant embodiment of the present invention as described in the above, therefore, measurement of VSWR, gain and cross polarized-wave characteristics has proved that, as shown graphically in FIG. 6, an efficiency of more than 80% and cross polarized-wave characteristics of more than about 32 dBi as represented by a solid line curve PRET could be obtained. In this case, it has been confirmed that the maximum efficiency has shown to be more than 96%, and has been found that the antenna 10 is remarkably improved in the antenna characteristics in contrast to a conventional planar antenna of circular polarized wave type as represented by a curve PRIR of a single dot chain line in FIG. 6.

It should be appreciated further that the apertures 13*a* and 13*b* constituting the radiating elements of the radiating plate 13, in particular, are full open holes or complete through holes made as punched off in the metal plate, without any provision of such patch elements in the openings as shown in, for example, the foregoing U.S. Pat. No. 4,929,959 to A. I. Zaghloul et al, and are still effective to maintain the high efficiency with the electromagnetic coupling of the power supply probes 12*b* to the apertures 13*a* and 13*b* realized, to remarkably improve the productivity with the arrangement very simplified, and also to sufficiently reduce required manufacturing costs.

Figure 7:
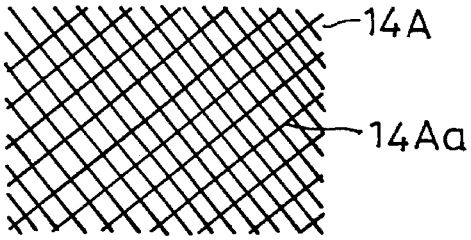
FIG. 7 shows in a fragmentary, schematic plan view the polarizer in another embodiment according to the present invention.

While in the foregoing embodiment shown in FIGS. 1–5 the polarizer 14 having the circuit pattern of the meander conductor lines is shown to be employed, it will be also possible to employ another polarizer 14A comprising a stack of three foamed plastic sheets, preferably, on which such biased lattice type circuit pattern 14Aa as shown in FIG. 7 is printed with a conducting ink.

Figure 8:
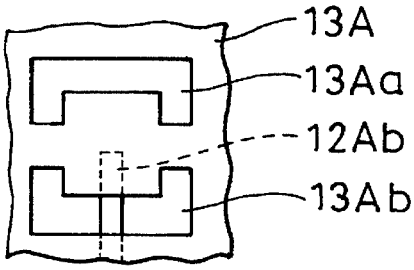
FIG. 8 shows in a fragmentary plan view as magnified a positional relationship between each pair of the apertures of the radiating circuit plate and each power supply probe of the power supplying circuit plate in still another embodiment of the present invention.

While in the foregoing embodiment of FIGS. 1–5 the aluminum plate is employed as the radiating circuit plate 13, further, it is also possible to employ any market-available flexible printed-circuit board, as shown in FIG. 8 a copper foil of which is subjected to am etching process, so as to form the radiating elements. In this case, too, it is possible to attain substantially the same function and effect as in the foregoing embodiment.

According to the present invention, as will be clear from the foregoing description, it is made possible to effectively re-utilize the leakage electric wave of the parallel plate mode which has been hitherto rendering the antenna characteristics only to be deteriorated, whereby it is enabled to realize a remarkably high efficiency, and to ensure the excellently wide-band cross polarization characteristics by the combination of antenna elements with the polarizer.

What is claimed is:

1. A planar antenna in a multilayered structure comprising:

a grounding conductor plate, a power supplying circuit plate, a radiating circuit plate which are mutually separated with a dielectric layer interposed between them, said radiating circuit plate being formed with a metal plate having a plurality of pairs of apertures made through the metal plate in the absence of any patch element and acting as radiating elements in a slot shape for generating linear polarized waves by an electromagnetic coupling of respective said pairs of apertures to respective power supply probes formed in said power supplying circuit plate in physically non-contacting relationship, and a polarizer disposed in front of said radiating plate for converting said linear polarized waves into circular polarized waves, wherein said pairs of apertures of said radiating circuit plate are arranged in a propagating direction of leakage electric waves generated in a parallel plate mode between said radiating circuit plate and said grounding conductor plate by said electromagnetic coupling of the respective pairs of apertures of the radiating circuit plate to said respective power supply probes of said power supplying circuit plate, for rendering said leakage electric waves to have a phase substantially of one wavelength or an integral multiple thereof between central axes of adjacent pairs of the apertures and to be radiated again through the apertures at position adjacent to those where the leakage electric waves are generated.

* * * * *